US006456282B1

(12) United States Patent
Karube

(10) Patent No.: US 6,456,282 B1
(45) Date of Patent: Sep. 24, 2002

(54) LOAD DRIVE CIRCUIT AND LIQUID CRYSTAL DISPLAY DEVICE

(75) Inventor: Masao Karube, Fukaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 186 days.

(21) Appl. No.: 09/696,971

(22) Filed: Oct. 27, 2000

(30) Foreign Application Priority Data

Oct. 29, 1999 (JP) ..... 11-309173

(51) Int. Cl.[7] ..... G09G 5/00

(52) U.S. Cl. ..... 345/204; 345/89; 345/92; 345/98; 345/99; 345/100

(58) Field of Search ..... 345/98, 100, 204, 345/89, 92, 99

(56) References Cited

U.S. PATENT DOCUMENTS 5,087,890 A * 2/1992 Ishiguro et al. ..... 330/259
5,111,195 A * 5/1992 Fukuoka et al. ..... 340/811
5,623,279 A * 4/1997 Itakura et al. ..... 345/98

* cited by examiner

*Primary Examiner*—Richard Hjerpe
*Assistant Examiner*—Jennifer T. Nguyen
(74) *Attorney, Agent, or Firm*—Oblon, Spivak, McClelland, Maier & Neustadt, P.C.

(57) ABSTRACT

A inverting amplifier circuit 10 for controlling the voltage of the signal line S is provided in a load drive circuit 11. Before the inverting amplifier circuit 10 controls the voltage of the signal line S, the voltage of each inverter INV1 to INV3 constituting the inverting amplifier circuit 10 is set at the voltage substantially equal to each threshold voltage thereof. As a result, even when the threshold voltages of the inverters INV1 to INV3 vary, it is possible that this would not exert any influence on the voltage of the signal line S. Therefore, it is possible to provide the load drive circuit 11 not to be affected by the variation of the characteristic of the inverting amplifier circuit 10.

16 Claims, 12 Drawing Sheets

LOAD DRIVE CIRCUIT AND LIQUID CRYSTAL DISPLAY DEVICE

BACKGROUND OF THE INVENTION

1. Field of the Invention

This invention relates to a load drive circuit which supplies a drive load with an input signal inputted from outside. For example, the invention relates to the load drive circuit which is able to applied to a signal line drive circuit of a liquid crystal display integral with a drive circuit.

2. Description of the Related Background Art

A liquid display device is made up of a pixel array portion with a matrix arrangement of signal lines and scanning lines, and drive circuits for driving the signal lines and the scanning lines. Conventionally, since the pixel array portion and the drive circuits were formed on separate substrates, it was difficult to reduce the costs of the liquid display device, and it was also difficult to increase the ratio of the real screen size relative to the outer dimensions of the liquid crystal display device.

Recently, since the manufacturing technology for making TFT (thin film transistor) on a glass substrate by using polysilicon as its material has been progressed, it has been made possible to make the pixel array portion and the drive circuits on a common glass substrate by using this technology.

However, at present since making uniform property polysilicon TFTs on a grass substrate is still difficult, the threshold voltage and mobility thereof vary. Therefore, even if the pixel array portion and the drive circuit are formed on a common substrate, there is still a possibility that the variation in property of TFTs causes a deterioration of the display quality such as inconsistency in luminance. Furthermore, the power consumption increases as well.

SUMMARY OF THE INVENTION

The invention has been made taking these points into consideration, and its object lies in providing a load drive circuit preventing fluctuations of a voltage supplied to a driven load due to an influence of unevenness of the transistor property or the minimizing influence even if the voltage is influenced by the unevenness.

In order to accomplish the aforementioned and other objects, according to one aspect of the present invention, a load drive circuit supplied with an input signal having a predetermined voltage amplitude and supplying a signal line connected with a load with the voltage of the input signal, comprising:

a signal line voltage control circuit, a first terminal of which is connected to the signal line, configured to control the voltage of the signal line so as to rise the voltage of the signal line when the voltage of the signal line is lower than that of the input signal and drop the voltage of the signal line when the voltage of the signal line is higher than that of the input signal, the signal line voltage control circuit including an odd number of inverters connected in series and setting each input terminal of the inverters at each threshold voltage of the inverters;

a first differential voltage holding circuit, a first terminal of which is connected to a second terminal of the signal line voltage control circuit and a second terminal of which is connected to an input terminal of the input signal when the input signal is supplied and connected to the signal line when the signal line voltage control circuit controls the voltage of the signal line, the first differential voltage holding circuit holding a differential voltage between the threshold voltage of the inverter positioned nearest to the input side of the signal line voltage control circuit and the voltage of the input signal when the signal line voltage control circuit controls the voltage of the signal line; and a first differential voltage setting circuit configured to set the first differential voltage holding circuit at the differential voltage to be held in the first differential voltage holding circuit before the signal line voltage control circuit controls the voltage of the signal line.

According to another aspect of the present invention, a liquid crystal display device comprising:

a pixel array portion formed on a substrate, having signal lines and scanning lines aligned in longitudinal and transverse directions and having pixel electrodes near respective nodes of the lines; and a drive circuit formed on the substrate to drive driving lines which are the signal lines and/or the scanning lines, wherein the drive circuit includes at least one load drive circuit supplied with an input signal having a predetermined voltage amplitude and supplying the driving line with the voltage of the input signal, the load drive circuit comprising:

a driving line voltage control circuit, a first terminal of which is connected to the driving line, configured to control the voltage of the driving line so as to rise the voltage of the driving line when the voltage of the driving line is lower than that of the input signal and drop the voltage of the driving line when the voltage of the driving line is higher than that of the input signal, the driving line voltage control circuit including an odd number of inverters connected in series and setting each terminal of the inverters at each threshold voltage of the inverters;

a first differential voltage holding circuit, a first terminal of which is connected to a second terminal of the driving line voltage control circuit and a second terminal of which is connected to an input terminal of the input signal when the input signal is supplied and connected to the driving line when the driving line voltage control circuit controls the voltage of the driving line, the first differential voltage holding circuit holding a differential voltage between the threshold voltage of the inverter positioned nearest to the input side of the driving line voltage control circuit and the voltage of the input signal when the driving line voltage control circuit controls the voltage of the driving line; and a first differential voltage setting circuit configured to set the first differential voltage holding circuit at the differential voltage to be held in the first differential voltage holding circuit before the driving line voltage control circuit controls the voltage of the driving line.

According to a further aspect of the present invention, a load drive circuit supplied with an input signal having a predetermined voltage amplitude and supplying a signal line connected with a load with the voltage of the input signal, comprising:

an inverting amplifier circuit, an output terminal of which is connected to the signal line when the inverting amplifier circuit controls the voltage of the signal line, including an odd number of threshold voltage setting inverter circuits connected in series, each of the threshold voltage setting inverter circuits having an inverter, a switch connecting between an input terminal and an output terminal of the inverter before the inverting amplifier circuit controls the voltage of the signal line, and a first capacitor connected to the input terminal of the inverter;

a second capacitor, one end of which is connected to an input side of the inverting amplifier circuit, and the other end of which is connected to an input terminal of the input signal when the input signal is supplied and connected to the signal line when the inverting amplifier circuit controls the voltage of the signal line; and a constant voltage supplying circuit connected to the one end of the second capacitor and configured to supply a given voltage when a differential voltage to be held in the second capacitor during the inverting amplifier circuit controlling the voltage of the signal line is set in the second capacitor.

According to a still further aspect of the present invention, a load drive circuit supplied with an input signal having a predetermined voltage amplitude and supplying a signal line connected with a load with the voltage of the input signal, comprising:

an inverting amplifier circuit, an output terminal of which is connected to the signal line when the inverting amplifier circuit controls the signal line, including:

a first threshold voltage setting inverter circuit positioned nearest to the input side of the inverting amplifier circuit, and having an inverter and a switch temporarily connecting between an input terminal and an output terminal of the inverter before the inverting amplifier circuit controls the voltage of the signal line; and an even number of second threshold voltage setting inverter circuits connected in series, each of the second threshold voltage setting inverter circuits having an inverter, a switch temporarily connecting between an input terminal and an output terminal of the inverter before the inverting amplifier circuit controls the voltage of the signal line and a first capacitor connected to the input terminal of the inverter; and a second capacitor, one end of which is connected to the input terminal of the first threshold voltage setting inverter circuit, and the other end of which is connected to an input terminal of the input signal when the input signal is supplied and connected to the signal line when the inverting amplifier circuit controls the voltage of the signal line.

According to another aspect of the present invention, a load drive circuit supplied with an input signal having a voltage amplitude and supplying a signal line connected a load with the voltage of the input signal, comprising.

a differential amplifier circuit having an inverting input terminal, a non-inverting input terminal supplied with a reference voltage and an output terminal connected to the signal line;

a differential voltage holding circuit connected to the inverting input terminal of the differential amplifier circuit and configured to hold a differential voltage between the voltage of the input signal and the reference voltage; and a first feedback circuit configured to supply the voltage of the input signal to the signal line while a feedback loop including the differential voltage holding circuit is constituted by connecting between the output terminal of the differential amplifier circuit and the differential voltage holding circuit with the differential voltage holding circuit holding the differential voltage.

According to a further aspect of the present invention, a liquid crystal display device comprising:

a pixel array portion formed on a substrate, having signal lines and scanning lines aligned in longitudinal and transverse directions and having pixel electrodes near respective nodes of the lines; and a drive circuit formed on the substrate to drive driving lines which are the signal lines and/or the scanning lines, wherein the drive circuit includes at least one load drive circuit supplied with an input signal having a predetermined voltage amplitude and supplying the driving line with the voltage of the input signal, the load drive circuit comprising:

a differential amplifier circuit having an inverting input terminal, a non-inverting input terminal supplied with a reference voltage and an output terminal connected to the driving line;

a differential voltage holding circuit connected to the inverting input terminal of the differential amplifier circuit and configured to hold a differential voltage between the voltage of the input signal and the reference voltage; and a first feedback circuit configured to supply the voltage of the input signal to the driving line while a feedback loop including the differential voltage holding circuit is constituted by connecting between the output terminal of the differential amplifier circuit and the differential voltage holding circuit with the differential voltage holding circuit holding the differential voltage.

DETAILED DESCRIPTION OF THE PREFERRED EMBODIMENTS

A load drive circuit of the invention is specifically explained below with reference to the drawings. Hereinafter, an example that the load drive circuit of the invention is applied to a signal line drive circuit of a liquid crystal display device is explained.

First Embodiment

A load drive circuit of the first embodiment according to the invention, the voltage of an input terminal of each inverter in an inverting amplifier circuit for controlling voltage of a signal line is set to be substantially equal to the threshold voltage of the each inverter. Accordingly, the voltage of the signal line is controlled to be at a desired value even the threshold voltage of the each inverter varies. It is explained in detail below with reference to the drawings.

Figure 1:
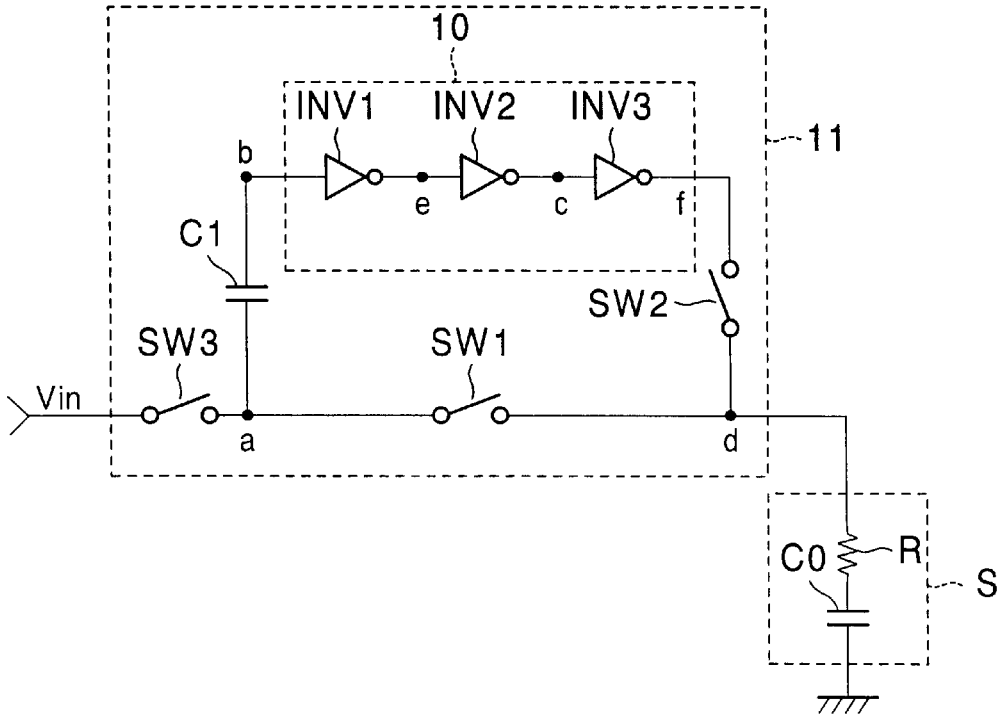
FIG. 1 is a circuit diagram showing the structure of the major part of a load drive circuit according to the first embodiment of the invention.
Figure 2:
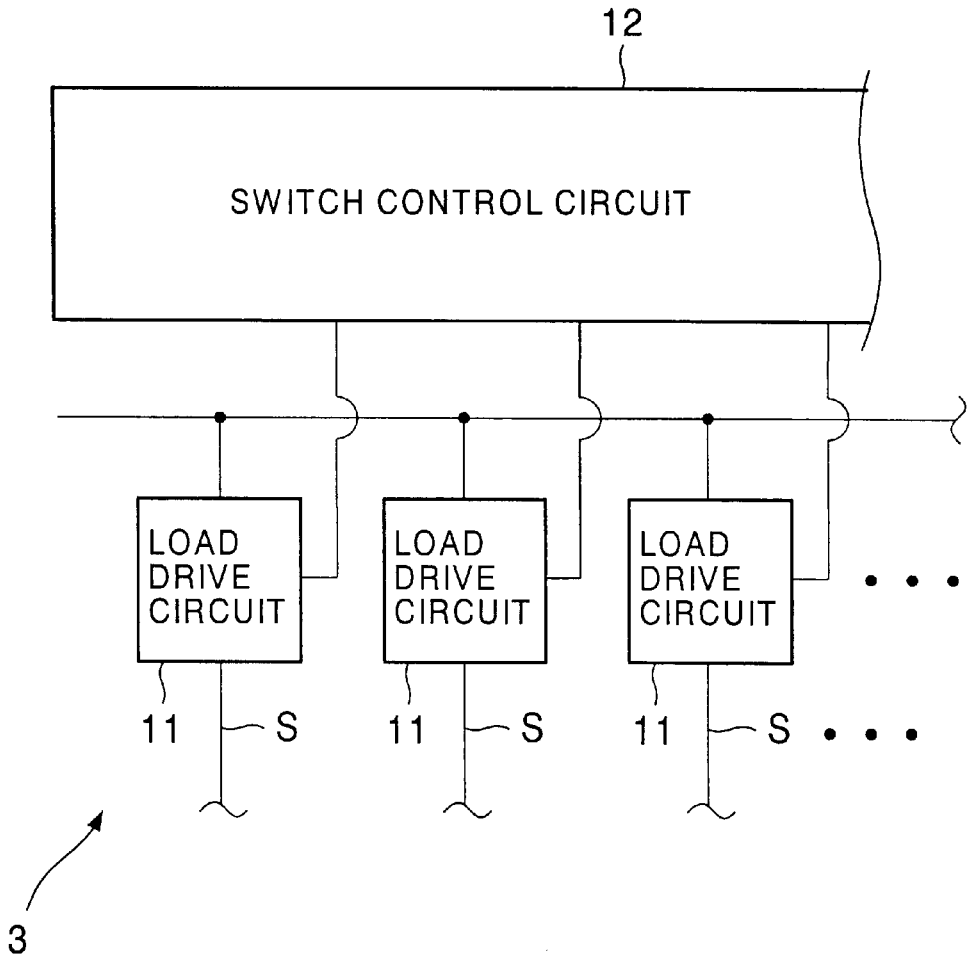
FIG. 2 is a block diagram schematically showing the entire structure of the load drive circuit.
Figure 3:
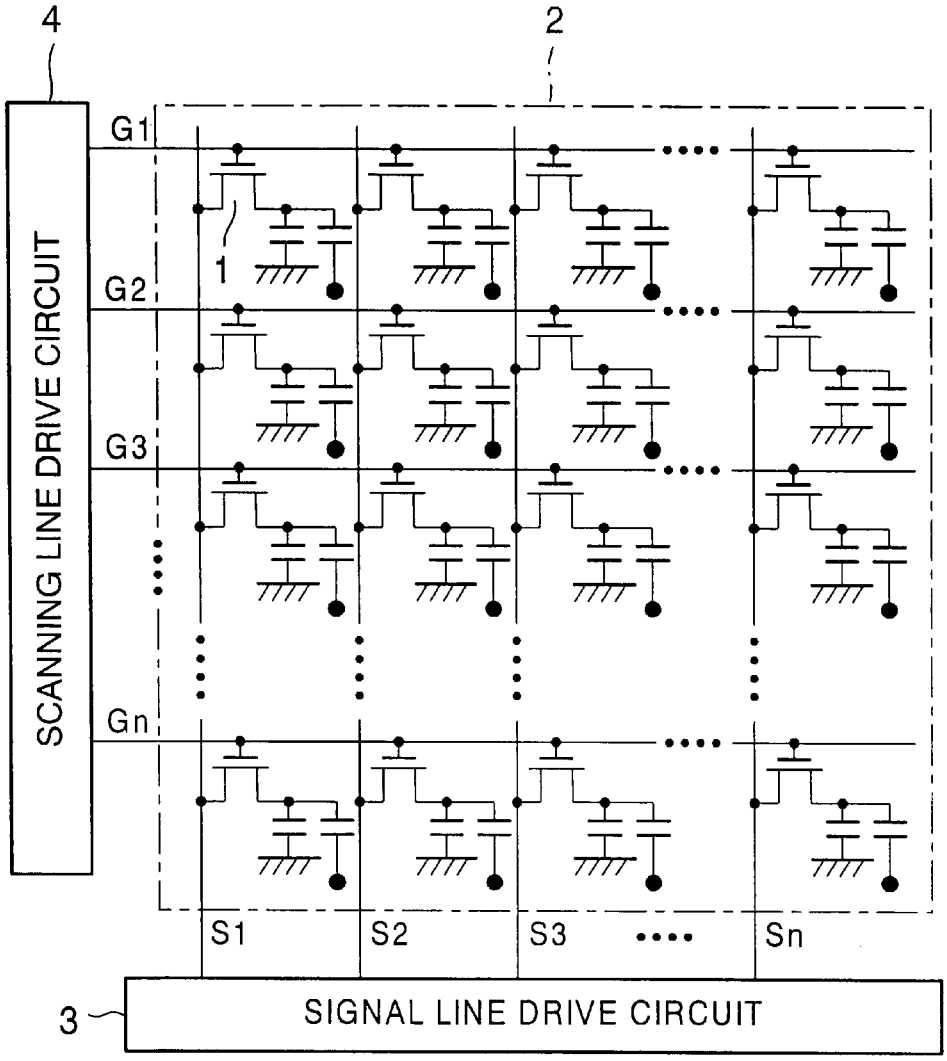
FIG. 3 is a block diagram schematically showing a liquid crystal display device in which the load drive circuit of FIG. 1 is employed as a signal line drive circuit.

FIG. 1 is a circuit diagram showing the structure of the major part of a load drive circuit according to the first embodiment of the invention, FIG. 2 is a block diagram schematically showing the entire structure of the load drive circuit of FIG. 1, FIG. 3 is a block diagram schematically showing a liquid crystal display device having the load drive circuit of FIG. 2 used as a signal line drive circuit.

The liquid crystal display device of FIG. 3 is made up of a pixel array portion 2, a signal line drive circuit 3 and a scanning line drive circuit 4. Formed in the pixel array 2 are signal lines S1~Sn and scanning lines G1~Gm in columns and rows, and formed near their crossing points are pixel displaying TFT1. The signal line drive circuit 3 is a circuit for driving these signal lines S1~Sn. The scanning line drive circuit 4 is a circuit for driving the scanning lines G1~Gm.

Each portion shown in FIG. 3 is formed on a common substrate, and transistors forming the signal line drive circuit 3 and the scanning line drive circuit 4 are made in the same manufacturing process as that of pixel driving TFT1.

The signal line drive circuit 3 has drive circuits shown in FIG. 2. The drive circuit of FIG. 2 includes load drive circuits 11 provided in each signal line and a switch control circuit 12 for switching and controlling various switches in those load drive circuits 11.

FIG. 1 is a circuit diagram of the load drive circuit 11. As shown in FIG. 1, the load drive circuit 11 includes switches SW1 to SW3, an inverting amplifier circuit 10 with a front stage inverter INV1, a middle stage inverter INV2, a back stage inverter INV3, and a capacitor C1. Connected to a signal line S driven by the load drive circuits 11 are pixel display TFTs, liquid crystal capacitances, auxiliary capacitances, and so on, as shown in FIG. 3. FIG. 1 illustrates, however, the load of the signal line S in form of an equivalent circuit of the resistor R and the capacitor CO for simplicity.

One end of the switch SW1 is connected to the signal line S, and the other end of the switch SW1 is connected to one end of the switch SW3 and one end of the capacitor C1. The other end of the switch SW3 is connected to an input terminal supplied with an input video signal Vin. The other end of the capacitor C1 is connected to the input terminal of the inverting amplifier circuit 10. The output terminal of the inverting amplifier circuit 10 is connected to one end of the switch SW2. The other end of the switch SW2 is connected to the signal line S.

The inverting amplifier circuit 10 is made up of the front stage inverter INV1, the middle stage inverter INV2 and the back stage inverter INV3, which are connected in series. The switches SW1 to SW3 are controlled by the switch control circuit 12 of FIG. 2.

In FIG. 1, a connecting point of the switch SW1 and the capacitor C1 is node "a", a connecting point of the capacitor C1 and the inverting amplifier circuit 10 is node "b", a connecting point of the middle stage inverter INV2 and the back stage inverter INV3 is node "c", a connecting point of the switches SW1 and SW2 is node "d", a connecting point of the front stage inverter INV1 and the middle stage inverter INV2 is node "e" and a connecting point of the back stage inverter INV3 and switch SW2 is node "f".

The inverting amplifier circuit 10 forms a signal line voltage control circuit in this embodiment, the capacitor C1 forms a first differential voltage holding circuit in this embodiment, and the switch SW3 forms a first differential voltage setting circuit in this embodiment.

Figure 4:
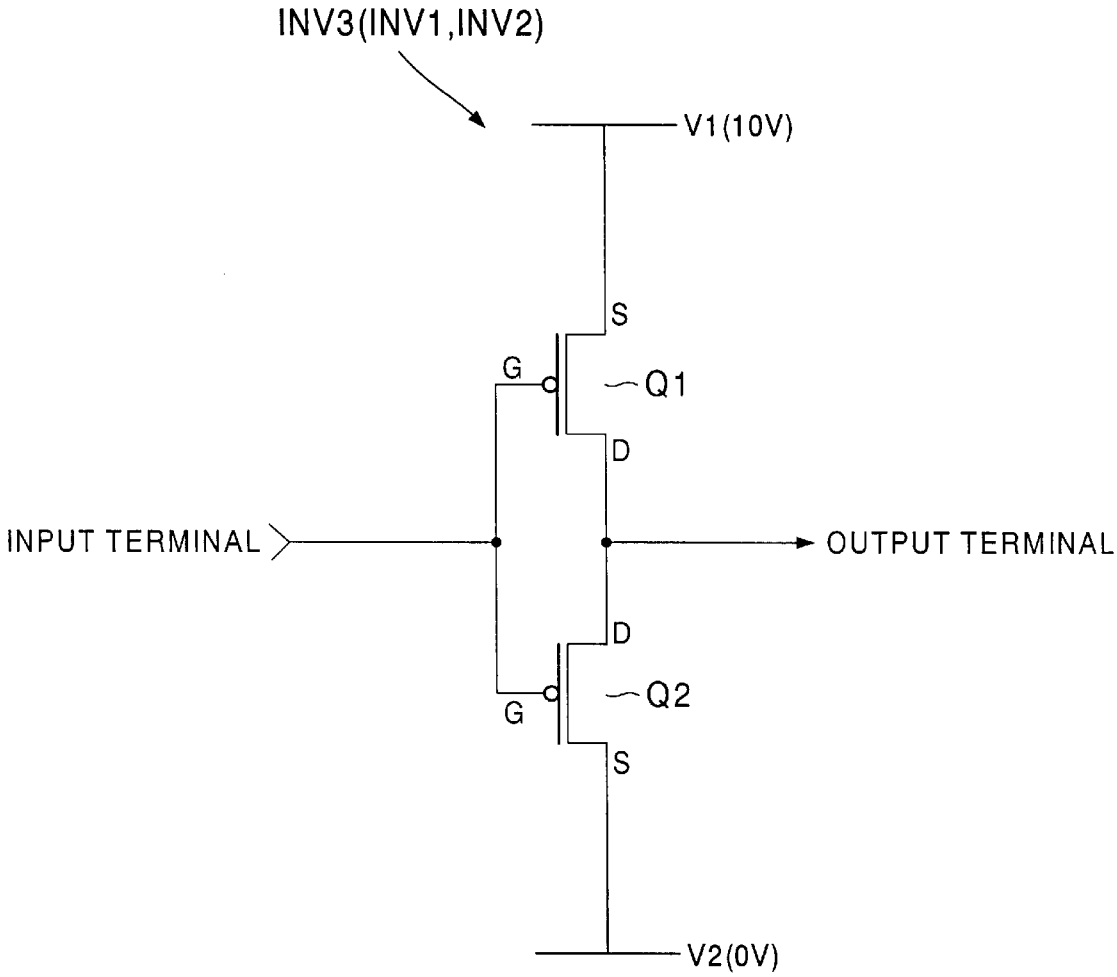
FIG. 4 is a diagram showing an example of circuit arrangement of a inverter according to the first embodiment of the invention.

FIG. 4 is a diagram showing an example of circuit structure of the back stage inverter INV3. The structure of the front stage inverter INV1 and the middle stage inverter INV3 are the same as this. As shown in FIG. 4, the back stage inverter INV3 is made up of a P-type MOS transistor Q1 and an N-type MOS transistor Q2. These MOS transistors Q1 and Q2 are provided and connected in series between the reference voltage terminal in a voltage V1 (for example, 10V) and the reference voltage terminal in a voltage V2 (for example, 0V). Moreover, gate terminals of the MOS transistors Q1 and Q2 are commonly connected to the input terminal of the back stage inverter INV3, and drain terminals of the MOS transistors Q1 and Q2 are commonly connected to the output terminal of the back stage inverter INV3.

Figure 5:
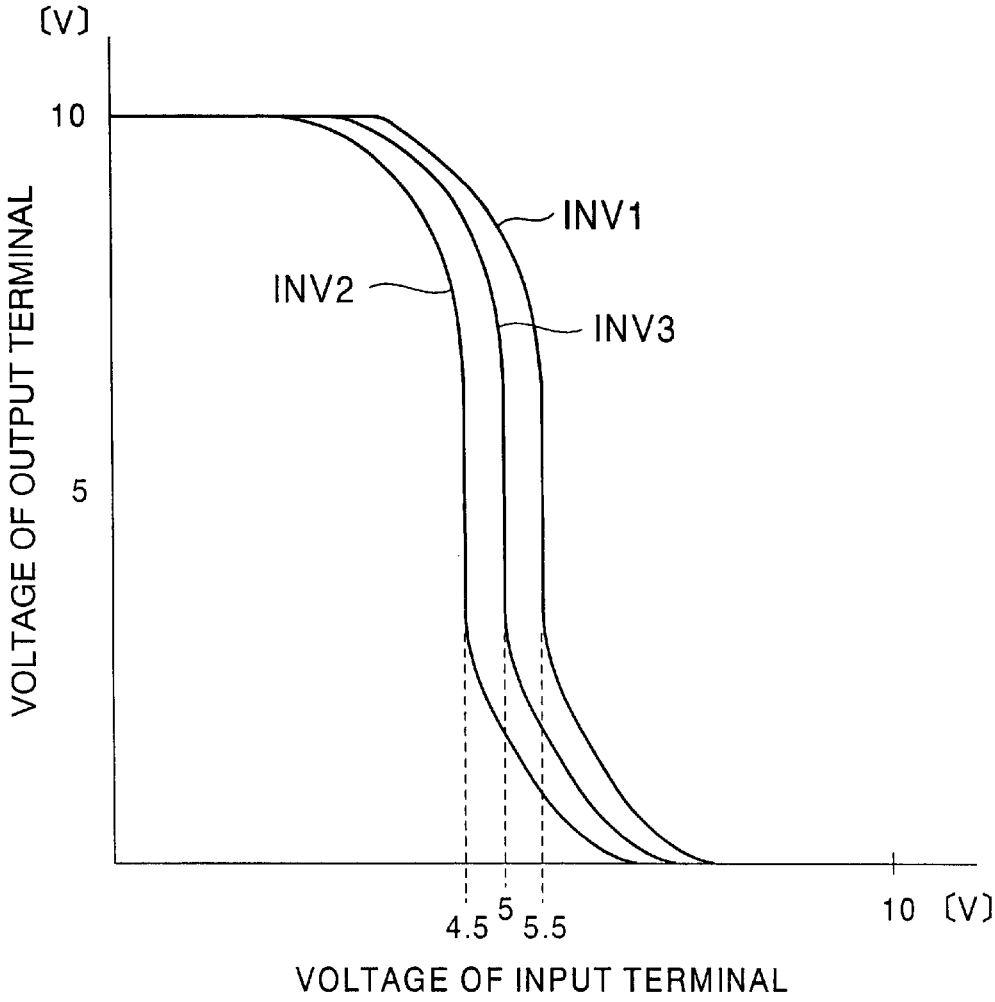
FIG. 5 is a graph showing fluctuations in input-output characteristics of the inverter according to the first embodiment of the invention.

FIG. 5 is a graph showing input-output characteristics of the inverters INV1 to INV3 according to this embodiment. In an example of the graph shown in FIG. 5, the threshold voltage, which should be 5V inherently, is 5.5V in the front stage inverter INV1. The threshold voltage, which should be 5V inherently, is 4.5V in the middle stage inverter INV2. The threshold voltage is 5V as inherently designed. The reason why the threshold voltages of the inverters INV1 to INV3 vary is that it is difficult to form polysilicon with a uniform property on a glass substrate, and for this reason the characteristics of the MOS transistors also vary.

Figure 6:
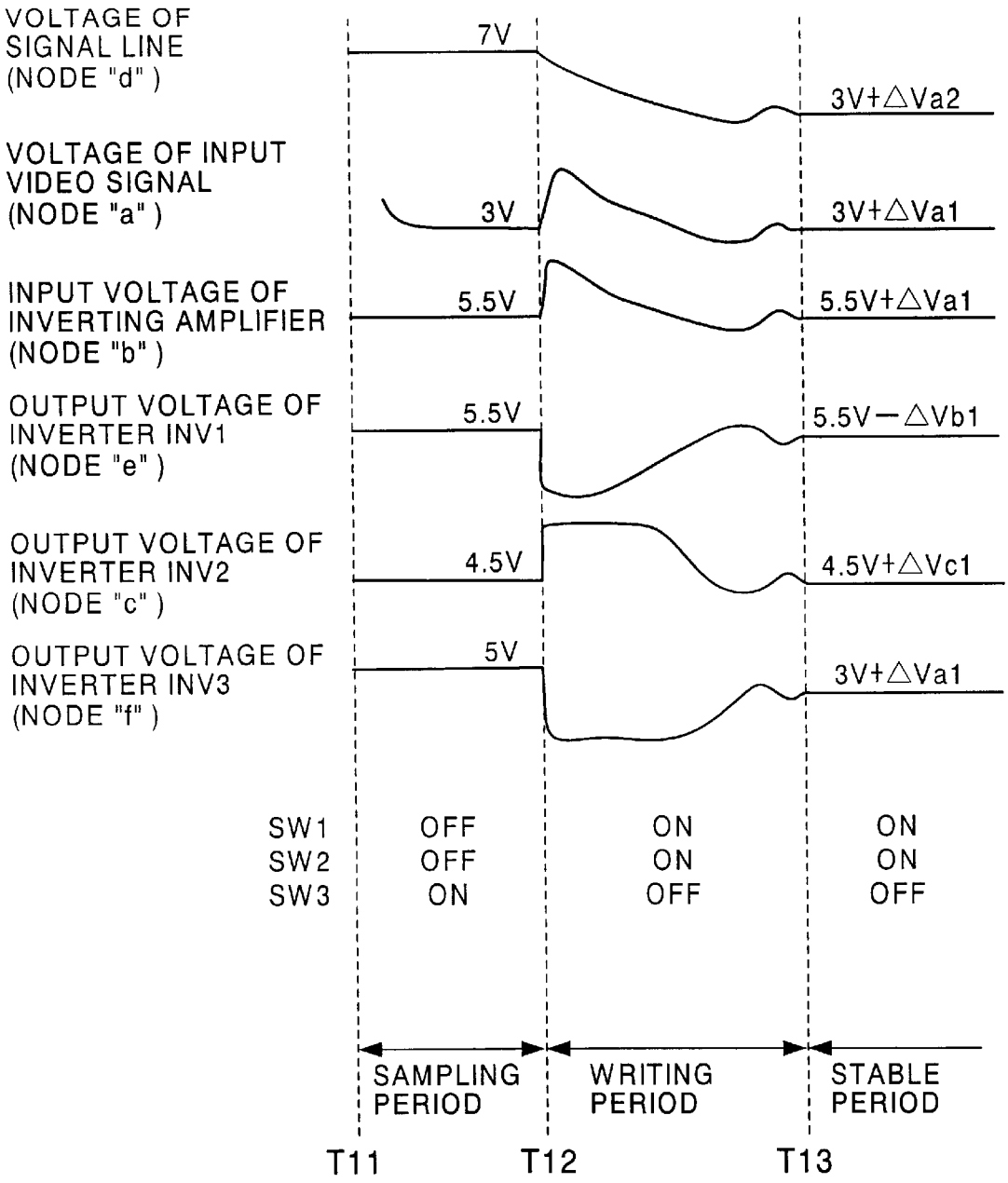
FIG. 6 is a timing chart of different points in the load drive circuit according to the first embodiment.

FIG. 6 is a timing diagram of operations of respective portions in the load drive circuit 11 of FIG. 1. Explained below are operations of the load drive circuit 11 of FIG. 1, using this timing diagram.

First, in the period from time T11 to T12 (sampling period), the switch control circuit 12 turns the switch SW3 ON and turns the other switches SW1 and SW2 OFF. As a result, the voltage of the node "a" of FIG. 1 becomes substantially equal to the voltage of the input video signal Vin. FIG. 6 shows an example in which the voltage of the input video signal Vin is 3V. However, since the switch SW1 is OFF, the voltage of the signal line S (node "d" in FIG. 1) maintains the voltage supplied before time T11.

In an example of FIG. 6, it maintains 7V.

As described above, assuming here that the threshold voltage of the front stage inverter INV1 is 5.5V, the threshold voltage of the middle stage inverter INV2 is 4.5V, and the threshold voltage of the back stage inverter INV3 is 5V, the voltage at the input terminal of the frond stage inverter INV1 should be set at 5.5V by some means, the voltage at the input terminal of the middle stage inverter INV2 should be set at 4.5V, and the voltage at the input terminal of the back stage inverter INV3 should be set at 5V. That is, each of the voltages at the input terminals of the inverters INV1 to INV3 is set substantially equal to each threshold voltage of the inverters INV1 to INV3. A technique for setting the each input terminal of the inverters INV1 to INV3 to each of the threshold voltage will be explained later with another embodiment.

By setting the input terminals of the inverters INV1 to INV3 substantially equal to each of the threshold voltage, the inverting amplifier circuit 10 has approximately the highest amplification factor. The amplification factor of the inverting amplifier. circuit 10 means the ratio of the amount in change of an input voltage to the amount in change of an output voltage. That is, by this setting, even when the voltage of the input terminal of the inverting amplifier circuit 10 changes slightly, the voltage of the output terminal of the inverting amplifier circuit 10 is inverted and changed sharply.

Furthermore, as described above, the voltage of the node "a" is 3V which is equal to the voltage of the input video signal Vin, and the voltage of the node "b" is 5.5V which is equal to the voltage of the node "e" described above. As a result, in the period between time T11 and time T12 (sampling period), the capacitor C1 is set to have the differential voltage (for example, 2.5V) between the voltage (for example, 3V) of the input video signal Vin and the threshold voltage (for example, 5.5V) of the front stage inverter INV1. The capacitor C1 should hold this differential voltage after time T12, which will be described later.

In the periods (the writing period and the stable period) after time T12, the switch control circuit 12 turns the switches SW1 and SW2 ON and turns the other switch SW3 OFF. At the point of time T12, the node "a" is at 3V whereas node "d" is at 7V in FIG. 1. Therefore, when the switch SW1 turns ON, the voltage at the node "a" rises due to affection by the node d. Since the capacitor C1 maintains the above-mentioned differential voltage (2.5V), the voltage at the node "b" in FIG. 1, which is at the opposite end of the capacitor C1, also rises following the voltage at the node "a".

As the voltage at the node "b" of FIG. 1 rises, the logical output of the front stage inverter INV1 shifts toward the LOW level (for example, 0V), the logical output of the middle stage inverter INV2 shifts toward the HIGH level (for example, 10V), and the logical output of the back stage inverter INV3 shifts toward the LOW level (for example, 0V). That is, as the voltage at the node "b" of FIG. 1 rises, the logical output of the inverting amplifier circuit 10 tries to invert and become low level (for example, 0V). As a result, the voltage of the signal line S drops. As the voltage of the signal line S drops, the voltages of the nodes "a" and "b" also drop.

When the voltage of the signal line S (the node "d" of FIG. 1) keeps dropping, the voltage of the signal line S eventually becomes equal to 3V, which is the voltage of the input video signal Vin, and the voltage of the node "a" of FIG. 1 also eventually becomes equal to 3V. Since the capacitor C1 maintains the above-mentioned differential voltage (2.5), the voltage of the node "b" of FIG. 1 becomes 5.5V, which is the threshold voltage of the front stage inverter INV1. Therefore, the logical output of the front stage inverter INV1 tries to invert and become the HIGH level (for example, 10V), the logical output of the middle stage inverter INV2 tries to invert and become the LOW level (for example, 0V), and the logical output of the back stage inverter INV3 tries to invert and become the HIGH level (for example, 10V). That is, as the voltage of the node "b" of FIG. 1 is under 3V, the logical output of the inverting amplifier circuit 10 tries to invert and become the HIGH level (for example, 10V). As a result, the voltage of the signal line S also rises. As the voltage of the signal line S rises, the voltages of the nodes "a" and "b" also responsively rises. By repeating this operation, after time T13, the voltage of the signal line S converges at 3V, which is the voltage of the input video signal, and is stabilized at this voltage.

Actually, however, in actual fact, the voltage at the nodes "a", "d" and "f" of FIG. 1 are not completely stabilized at 3V. They are displaced by ΔVa1 of the offset voltage and become 3V+ΔVa1. Moreover, the voltage of the node "b" also is displaced by ΔVa1 of the offset voltage and become 5.5V+ΔVa1. As a result, the voltage of node "e" of FIG. 1 is displaced by ΔVb1 of the offset voltage and becomes 5.5V−ΔVb1. In addition, the voltage of the node "c" of FIG. 1 is displaced by ΔVc1 of the offset voltage and becomes 4.5V+ΔVc1.

However, as described above, the voltage of the each input terminal of the inverters INV1 to INV3 is set substantially equal to each of the threshold voltage in the period between time T11 and time T12, so that the amplification factor of the inverting amplifier circuit 10 is considerably large. As a result, it is possible that the offset voltage ΔVa1 is rather small. That is, the offset voltage ΔVa1 is considered substantially to be about 0V, and the voltages of nodes "d", "a" and "f" of FIG. 1 are substantially equal to 3V.

As explained above, in the load drive circuit 11 according to this embodiment, the voltage at the each input terminal of the front stage inverter INV1, the middle stage inverter INV2 and the back stage inverter INV3 constituting the inverting amplifier circuit 10 is set substantially equal to each of the threshold voltages thereof, and a feedback loop is constituted by the switches SW1 and SW2 and the inverting amplifier circuit 10 with the differential voltage between the voltage of the input video signal and the threshold voltage of the front stage inverter INV1 being held by the capacitor C1, so that the voltage of the signal line S is able to be set substantially equal to the voltage of the input video signal Vin.

That is, when the voltage of the signal line S is lower than that of the input video signal Vin (the voltage at the node "a" of FIG. 1), the resistance value between the source and the drain of the P-type MOS transistor Q1 constituting the inverter INV3 shown in FIG. 4 is smaller than that of the N-type MOS transistor Q2, so that the voltage V1 (for example, 10V) is supplied from the output terminal of the inverter INV3. As a result, the voltage of the signal lines arises.

On the other hand, when the voltage of the signal line S is higher than that of the input video signal Vin (the voltage at the node "a" of FIG. 1), the resistance value between the source and the drain of the P-type MOS transistor Q1 constituting the inverter INV3 shown in FIG. 4 is larger than that of the N-type MOS transistor Q2, so that the voltage of the signal line S is pulled in the voltage V2 (for example, 0V). As a result, the voltage of the signal lines drops. By repeating these operations, it is possible that the voltage of the signal line S is set substantially equal to the voltage of the input video signal Vin.

In addition, the voltage of each input terminal of the inverters INV1 to INV3 is set substantially equal to each of the threshold voltage thereof, and the differential voltage between the threshold voltage of the front stage inverter INV1 and the voltage of the input video signal Vin is held by the capacitor C1, so that the inverting amplifier circuit 10 is able to operate in the state that the amplification factor thereof is almost the largest. As a result, it is possible that the offset voltage ΔVa1 is brought as close as possible to 0V wherever possible, and that the voltage of the signal line S is set to be substantially equal to the voltage of the input video signal Vin.

Second Embodiment

The second embodiment of the invention is directed to showing a specific technique for setting the voltage at the each input terminal of each inverter INV1 to INV3 in the foregoing first embodiment in the threshold voltage of each inverter INV1 to INV3.

Figure 7:
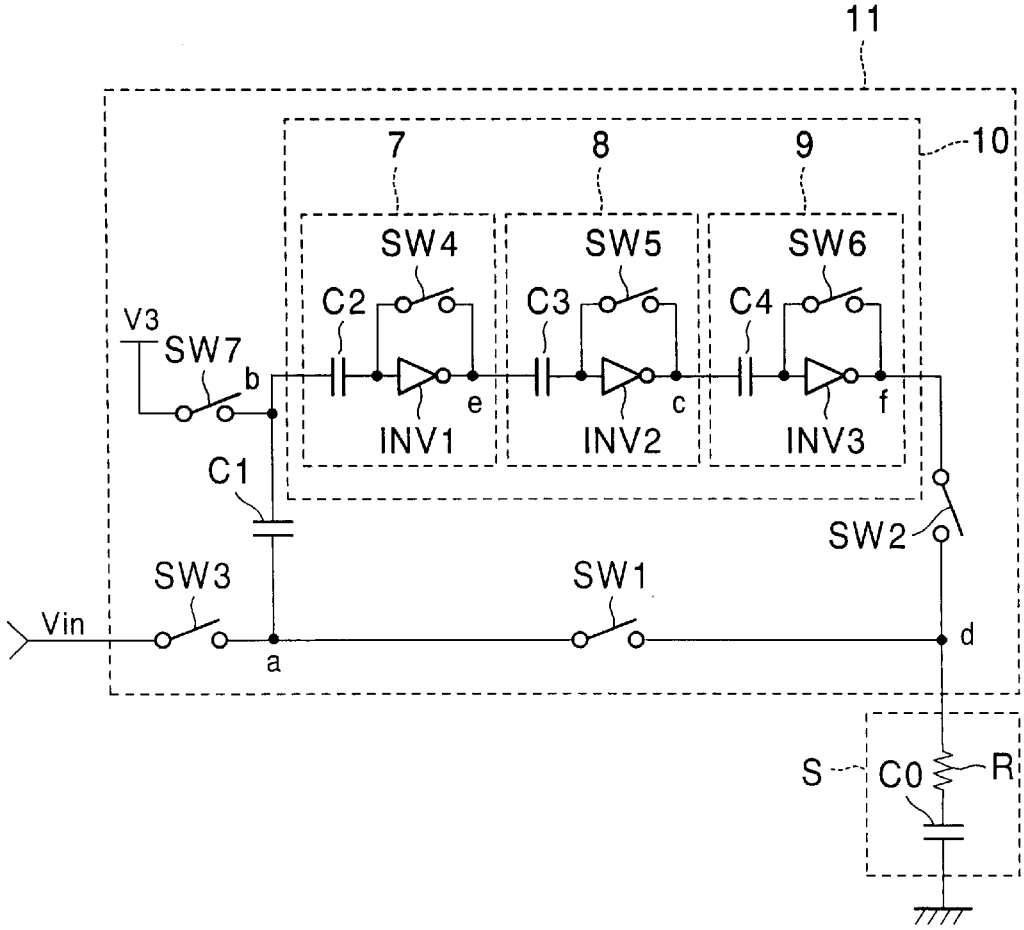
FIG. 7 is a circuit diagram showing the structure of the major part of a load drive circuit according to the second embodiment of the invention.

FIG. 7 is a circuit diagram of the load drive circuit 11 according to the invention, it is also used in the signal line drive circuit 3 in the liquid crystal display device similarly to the first embodiment. The load drive circuit 11 according to this embodiment includes switches SW4 to SW7 and capacitors C2 to C4 in addition to the load drive circuit 11 shown in FIG. 1.

One end of the switch SW4 is connected to the input terminal of the front stage inverter INV1, and the other end of the switch SW4 is connected to the output terminal of the front stage inverter INV1. One end of the switch SW5 is connected to the input terminal of the middle stage inverter INV2, and the other end of the switch SW5 is connected to the output terminal of the middle stage inverter INV2. One end of the switch SW6 is connected to the input terminal of the back stage inverter INV3, and the other end of the switch SW6 is connected to the output terminal of the back stage inverter INV3.

The capacitor C2 is provided between the other end of the capacitor C1 and the input terminal of the front stage inverter INV1, the capacitor C3 is provided between the output terminal of the front stage inverter INV1 and the input terminal of the middle stage inverter INV2, and the capacitor C4 is provided between the output terminal of the middle stage inverter INV2 and the input terminal of the back stage inverter INV3.

The above-mentioned front stage inverter INV1, the capacitor C2 and the switch SW4 form a threshold voltage setting inverter circuit 7 in the front stage, the middle stage inverter INV2, the capacitor C3 and the switch SW5 form a threshold voltage setting inverter circuit 8 in the middle stage, and the back stage inverter INV3, the capacitor C4 and the switch SW6 form a threshold voltage setting inverter circuit 9 in the back stage.

One end of the switch SW7 is connected to the other end of the capacitor C1, and the other end of the switch SW7 is connected to the reference voltage terminal at the voltage V3 (for example, 5V).

These switches SW4 to SW7 are also controlled by the switch control circuit 12 shown in FIG. 2, as in the case of the first embodiment.

In FIG. 7, a connecting point of the switch SW1 and the capacitor C1 is the node "a", a connecting point of the capacitors C1 and C2 is the node "b", a connecting point of the middle stage inverter INV2 and the capacitor C4 is the node "c", a connecting point of the switches SW1 and SW2 is the node "d", a connecting point of the inverter INV1 and the capacitor C3 is the node "e", and a connecting point of the back stage inverter INV3 and the switch SW2 is the node "f".

Furthermore, the inverting amplifier circuit 10 forms a signal line voltage control circuit in this embodiment, the capacitors C1 and C2 and the switch SW7 form a first differential voltage holding circuit in this embodiment, the switches SW3, SW4 and SW7 form a first differential voltage setting circuit in this embodiment, each of the capacitors C3 and C4 forms a second differential voltage holding circuit, each of the switches SW5 and SW6 forms a second differential voltage setting circuit, the capacitor C1 forms a third differentia voltage holding circuit, the capacitor C2 forms a fourth differential voltage holding circuit, and the switch SW7 forms a constant voltage supplying circuit.

Figure 8:
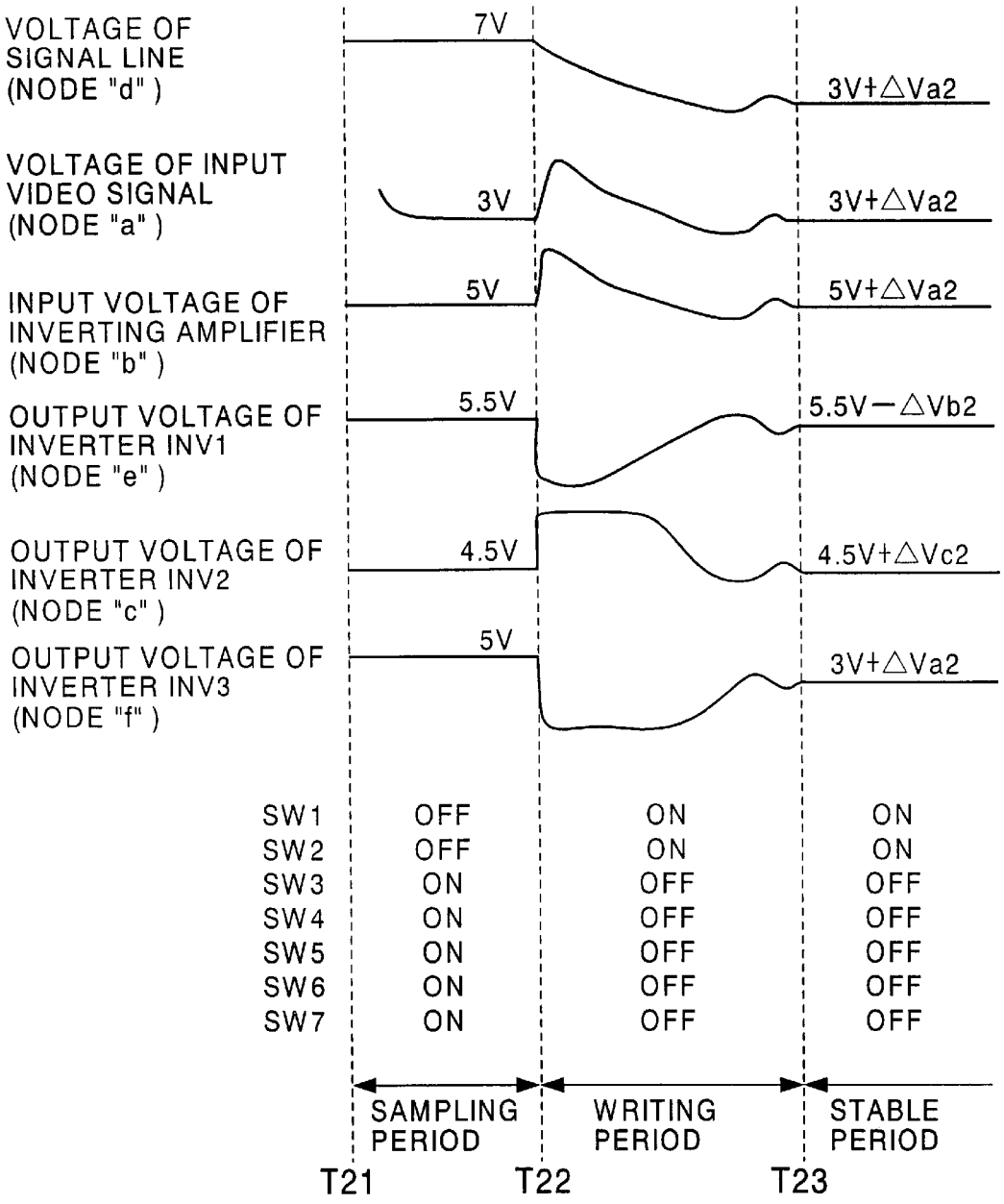
FIG. 8 is a timing chart of different points in the load drive circuit according to the second embodiment.

FIG. 8 is a timing diagram of operations of respective portions in the load drive circuit 11 of FIG. 7. Explained below are operations of the load drive circuit 11 of FIG. 7, using this timing diagram.

First, in the period from time T21 to T22 (sampling period), the switch control circuit 12 turns the switches SW3 to SW7 ON and turns the other switches SW1 and SW2 OFF. As a result, the voltage of the node "a" of FIG. 7 becomes substantially equal to the voltage of the input video signal Vin. FIG. 8 shows an example in which the voltage of the input video signal Vin is 3V. However, since the switch SW1 is OFF, the voltage of the signal line S (node "d" in FIG. 7) maintains the voltage supplied before time T21. In an example of FIG. 8, it maintains 7V.

Assuming here that the threshold voltage of the front stage inverter INV1 is 5.5V, the threshold voltage of the middle stage inverter INV2 is 4.5V, and the threshold voltage of the back stage inverter INV3 is 5V, the voltage at the input terminal of the frond stage inverter INV1 is set 5.5V, which is the same voltage as the node "e" of FIG. 7, because the switches SW4 to SW6 are ON. The voltage at the input terminal of the middle stage inverter INV2 is set 4.5V, which is the same voltage as the node "c" of FIG. 7. The voltage at the input terminal of the back stage inverter INV3 is set 5V, which is the same voltage as the node "f" of FIG. 7. That is, each of the voltage at the input terminal of the inverters INV1 to INV3 is set substantially equal to each of the threshold voltage of the inverters INV1 to INV3.

As described in the explanation of the first embodiment, each of the input terminals of the inverters INV1 to INV3 is set to have the voltage substantially equal to each of the threshold voltage thereof, so it is possible that the amplification factor of the inverting amplifier circuit 10 becomes close to the highest.

Furthermore, as described above, the voltage of the node "a" is 3V which is equal to the voltage of the input video signal Vin. On the other hand, since the switch SW7 is ON, the node "f" of FIG. 7, which is the other end of the capacitor C1, is the voltage V3 (for example, 5V).

As a result, in the period between time T21 and time T22 (sampling period), the capacitor C1 is set to have the differential voltage (for example, 2V) between the voltage (for example, 3V) of the input video signal Vin and the voltage V3 (for example, 5V). The capacitor C1 should hold this differential voltage after time T22, which will be described later. The capacitor C2 is set to have the differential voltage (for example, 0.5V) between the voltage V3 (for example, 5V) and the threshold voltage of the front stage inverter INV1 (for example, 5V). The capacitor C2 should hold this threshold voltage after time T22, which will be described later. The capacitor C3 is set to have the differential voltage (for example, −1V) between the threshold voltage of the front stage inverter INV1 (for example, 5.5V) and the threshold voltage of the middle stage inverter INV2 (for example, 4.5V). The capacitor C3 should hold this threshold voltage after time T22, which will be described later. The capacitor C4 is set to have the differential voltage (for example, 0.5V) between the threshold voltage of the middle stage inverter INV2 (for example, 4.5V) and the threshold voltage of the back stage inverter INV3 (for example, 5V). The capacitor C4 should hold this threshold voltage after time T22, which will be described later.

In the periods (the writing period and the stable period) after time T22, the switch control circuit 12 turns the switches SW1 and SW2 ON and turns the other switches SW3 to SW7 OFF. At the point of time T22, the node "a" is at 3V whereas node "d" is at 7V in FIG. 7. Therefore, when the switch SW1 turns ON, the voltage at the node "a" rises due to affection by the node "d". Since the capacitor C1 maintains the above-mentioned differential voltage (2V), the voltage at the node "b" in FIG. 7, which is the opposite end of the capacitor C1, also rises following the voltage at the node "a".

As the voltage at the node "b" of FIG. 7 rises, since the capacitor C2 maintains the above-mentioned differential voltage (0.5V), the voltage at the input terminal of the front stage inverter INV1, which is the opposite end of the capacitor C2, also rises following the voltage at the node "b". As the voltage of the input terminal of the front stage inverter INV1 rises, the logical output of the front stage inverter INV1 becomes the LOW level (for example, 0V), and the voltage at the node "e" of FIG. 7 drops.

As the voltage at the node "e" in FIG. 7 drops, since the capacitor C3 maintains the above-mentioned differential voltage (−1V), the voltage of the input terminal of the middle stage inverter INV2, at the opposite end of the capacitor C3, also drops. As the voltage of the input terminal of the middle stage inverter INV2 drops, the logical output of the middle stage inverter INV2 becomes the HIGH level (for example, 10V), and the voltage at the node "c" in FIG. 7 also rises.

As the voltage at the node "c" in FIG. 7 rises, since the capacitor C4 maintains the above-mentioned differential voltage (0.5V), the voltage of the input terminal of the back stage inverter INV3, at the opposite end of the capacitor C4, also rises. As the voltage of the input terminal of the back stage inverter INV3 rises, the logical output of the back stage inverter INV3 becomes the LOW level (for example, 0V), and the voltage at the node "f" in FIG. 7 drops. As the voltage at the node "f" in FIG. 7 drops, the voltage at the node "d", i.e. the voltage at the signal line S, also drops. As the voltage of the signal line S drops, the voltage at the nodes "a" and "b" also drop, responsively.

When the signal line S (the node "d" of FIG. 7) keeps dropping, the voltage of the signal line S eventually becomes equal to 3V, which is the voltage of the input video signal Vin, and the voltage of the node "a" of FIG. 7 also eventually becomes equal to 3V. Since the capacitor C1 maintains the above-mentioned differential voltage (2V) and the capacitor C2 maintains the above-mentioned differential voltage (0.5V), the voltage of the input terminal of the front stage inverter INV1 becomes 5.5V, which is the threshold voltage of the front stage inverter INV1. Therefore, the logical output of the front stage inverter INV1 tries to invert and become the HIGH level (for example, 10V). In addition, since the capacitor C3 maintains the above-mentioned differential voltage (−1V), the logical output of the middle stage inverter INV2 tries to invert and become the LOW level (for example, 0V). Furthermore, since the capacitor C4 maintains the above-mentioned differential voltage (0.5V), the logical output of the back stage inverter INV3 tries to invert and become the HIGH level (for example, 10V) That is, as the voltage of the node "a" of FIG. 7 is under 3V, the logical output of the inverting amplifier circuit 10 tries to invert and become the HIGH level (for example, 10V). As a result, the voltage of the signal line S also rises. As the voltage of signal line S rises, the voltage of the nodes "a" and "b" also rise, responsively. By repeating this operation, after time T23, the voltage of the signal line S converges in 3V, which is the voltage of the input video signal, and is stabilized at this voltage.

Actually, however, the voltages at the nodes "a", "d" and "f" of FIG. 7 are not completely stabilized at 3V, they are displaced by ΔVa2 of the offset voltage and become in 3V+ΔVa2. Moreover, the voltage of the node "b" is also displaced by ΔVa2 and becomes 5.5V+ΔVa2. As a result, the voltage of node "e" of FIG. 7 is displaced by ΔVb2 of the offset voltage and becomes 5.5V−ΔVb2. In addition, the voltage of the node "c" of FIG. 7 is displaced by ΔVc2 of the offset voltage and becomes 4.5V+ΔVc2.

However, as described above, the voltage of the each input terminal of the inverters INV1 to INV3 is set substantially equal to each of the threshold voltage in the period between time T21 and time T22, so that the amplification factor of the inverting amplifier circuit 10 has been considerably large. As a result, it is possible that the offset voltage ΔVa2 is rather small. That is, the offset voltage ΔVa2 is considered substantially to be about 0V, the voltage of nodes "d", "a" and "f" of FIG. 7 is substantially equal to 3V.

Figure 9:
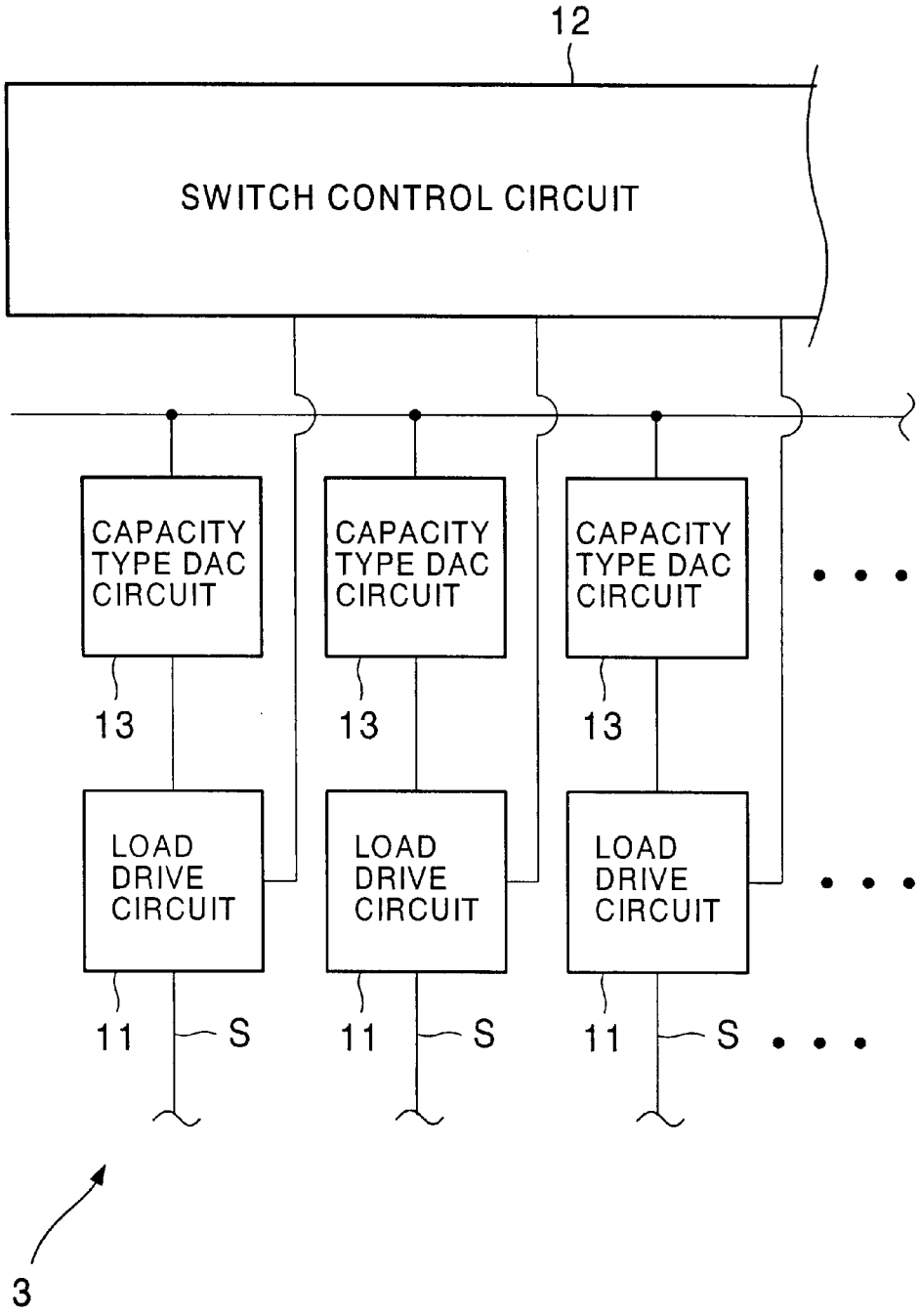
FIG. 9 is a block diagram showing a case where the load drive circuits are connected to outputs of capacity type DAC circuits.

Referring to FIG. 9, next explained is the reason why the load drive circuit 11 of FIG. 7 is provided with the switch SW7 to supply the node "b" in FIG. 7 with the voltage V3 (for example, 5V). FIG. 9 is a diagram showing an example of connecting the load drive circuit 11 to a capacity type DAC (Digital Analog Converter) circuit 13.

As shown in FIG. 9, when capacity type DAC circuit 13 is connected to the input side of the load drive circuit 11, the capacitor C1 in FIG. 7 is an output load for the capacity type DAC circuit 13. The node "a" in FIG. 7, which is one end of the capacitor C1, is supplied with the input video signal Vin, which is the output of the capacity type DAC circuit 13. Therefore, the voltage at the node "b" at the opposite side of the capacitor C1 in FIG. 7 has to be at the constant voltage when the differential voltage is set at the capacitor C1. That is, when the voltage at the node "b" in FIG. 7 varies depending on the threshold voltage of the front stage inverter INV1, there is the possibility that the output of the capacity type DAC circuit 13 does not output correctly to the node "a" in FIG. 7. Therefore, in this embodiment, the node "b", which is at the opposite side of the capacitor C1 in FIG. 7, is fixed at 5V by means of turning the switch SW7 ON in the period (sampling period) between the time T21 and the time T22 for setting the capacitor C1 at the threshold voltage.

As explained above, in the load drive circuit 11 according to the second embodiment, the voltage at the each input terminal of the front stage inverter INV1, the middle stage inverter INV2 and the back stage inverter INV3 constituting the inverting amplifier circuit 11 is set substantially equal to each of the threshold voltages thereof, and a feedback loop is constituted by the switches SW1 and SW2 and the inverting amplifier circuit 10 with the differential voltage at each point being held by the capacitors C1 to C4, so that the voltage of the signal line S is able to be set substantially equal to the voltage of the input video signal Vin.

That is, in the period between the time T21 and the time T22 (sampling period), the differential voltage between the voltage of the input video signal Vin and the threshold voltage of the front stage inverter INV1 is set and held at the capacitors C1 and C2, the differential voltage between the threshold voltage of the front stage inverter INV1 and the threshold voltage of the middle stage inverter INV2 is set and held at the capacitor C3, and the differential voltage between the threshold voltage of the middle stage inverter INV2 and the threshold voltage of the back stage inverter INV3 is set and held at the capacitor C4, so that the inverting amplifier circuit 10 is able to operate in the status that the amplification factor thereof is almost the largest, even if the threshold voltages of the inverters INV1 to INV3 vary. As a result, it is possible that the voltage of the signal line S is set at the voltage substantially equal to that of the input video signal Vin.

In addition, in the period between the time T21 and the time T22 (sampling time), since the voltage of the node "b", which is opposite side of the capacitor C1, is set in the voltage V3 (for example, 5V), when the capacity type DAC circuit 13 supplies the load drive circuit 11 with the input video signal Vin, it is possible to supply correctly the node "a" in FIG. 7 with the input video signal Vin, and to drive the load correctly.

Third Embodiment

The third embodiment of the invention is a simplified version of the circuit structure in the above-mentioned second embodiment by omitting the switch SW7 and the capacitor C2.

Figure 10:
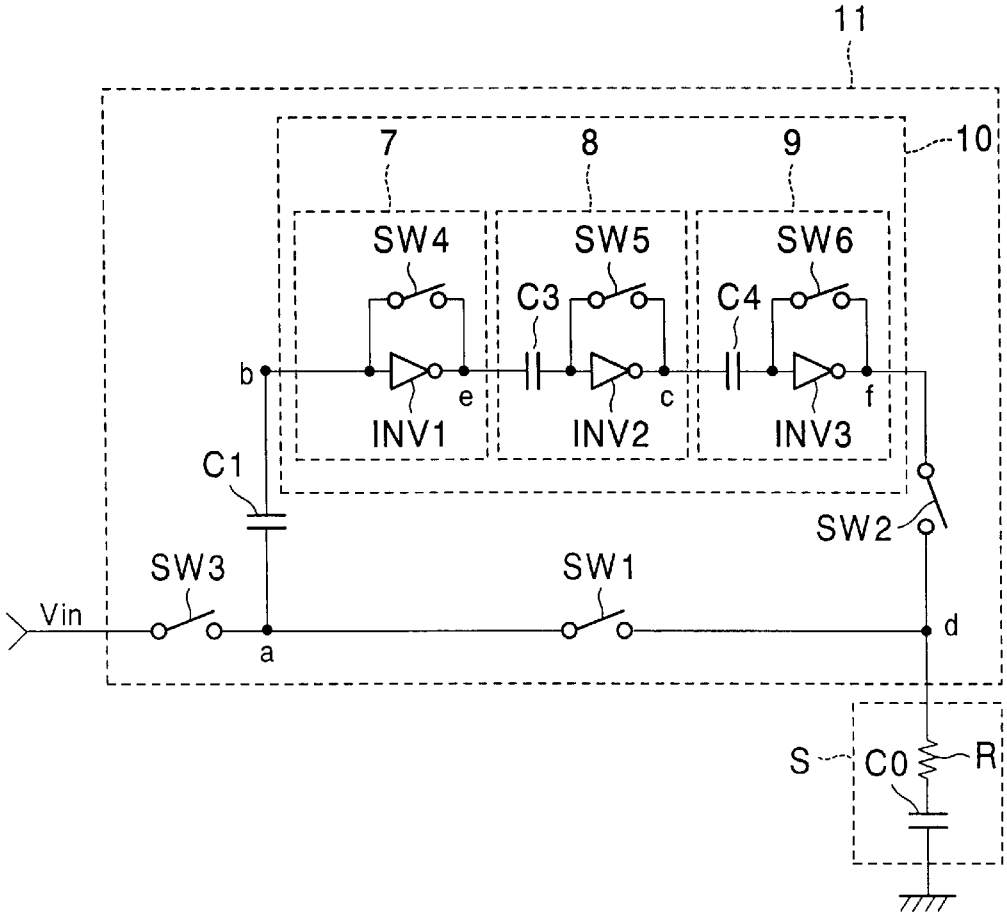
FIG. 10 is a circuit diagram showing the structure of the major part of a load drive circuit according to the third embodiment of the invention.

FIG. 10 is a circuit diagram of the load drive circuit 11 according to this embodiment. As shown in FIG. 10, in the load drive circuit 11 according to this embodiment, the threshold voltage setting inverter circuit 7 positioned nearest to the input side is not provided with the capacitor C2, so that the input terminal of the front stage inverter INV1 is directly connected to the other end of the capacitor C1. Therefore, the capacitor C1 holds the differential voltage between the voltage of the input video signal Vin and the threshold voltage of the front stage inverter INV1.

Then, the inverting amplifier circuit 10 forms a signal line voltage control circuit in this embodiment, the capacitor C1 forms a first differential voltage holding circuit in this embodiment, the switches SW3 and SW4 form a first differential voltage setting circuit in this embodiment, each of the capacitors C3 and C4 forms a second differential voltage holding circuit, each of the switches SW5 and SW6 forms a second differential voltage setting circuit.

Operations of the load drive circuit 11 according to this embodiment are identical to those of the above-mentioned first embodiment, and therefore the explanation thereof is omitted.

Fourth Embodiment

The fourth embodiment of the invention is directed to realizing the load drive circuit 11, of which the operation is identical to that of the above-mentioned embodiments, by using a differential amplifier circuit.

Figure 11:
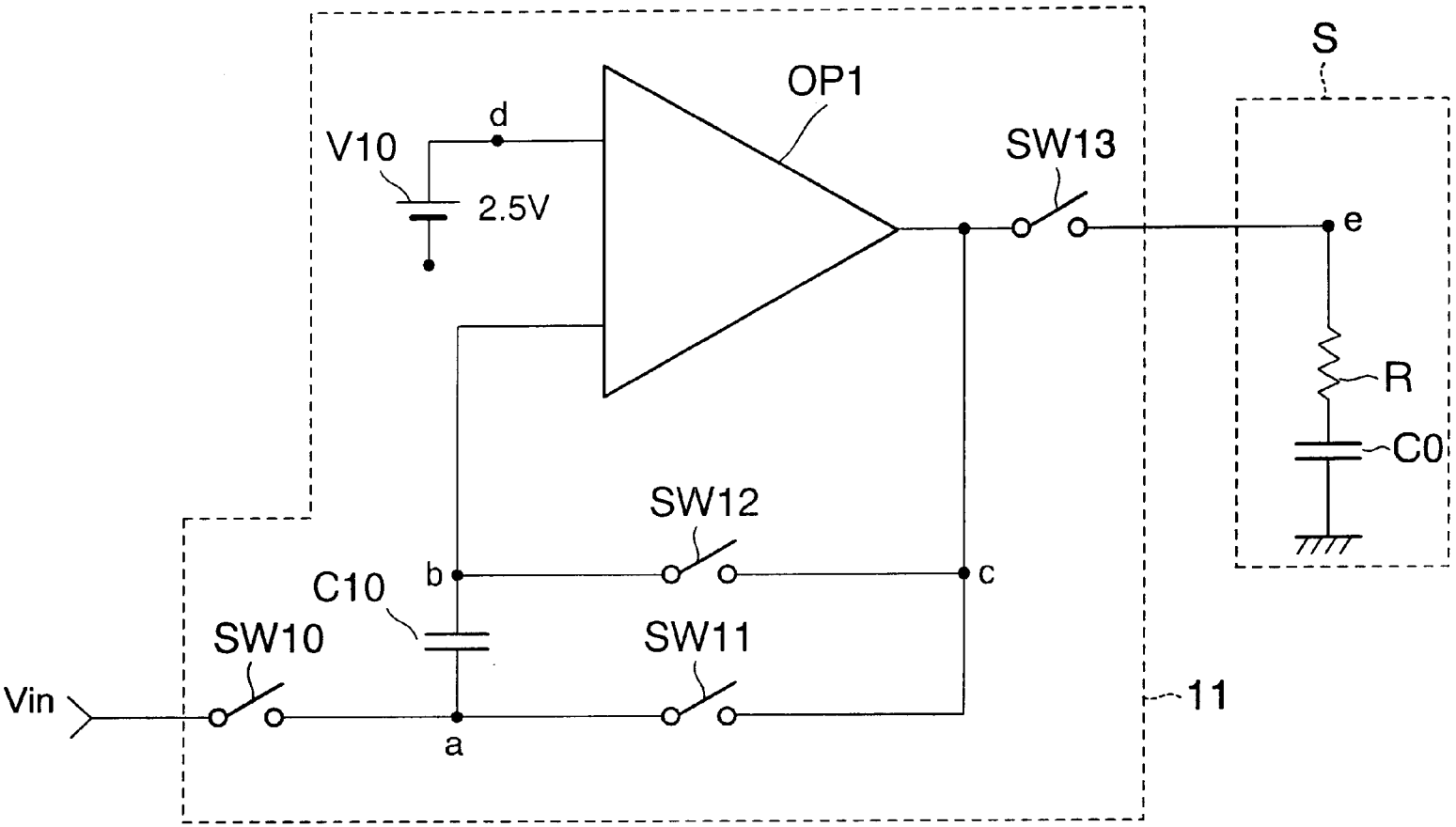
FIG. 11 is a circuit diagram showing the structure of the major part of a load drive circuit according to the forth embodiment of the invention.

FIG. 11 is a circuit diagram of the load drive circuit 11 according to this embodiment of the invention, which is used in the signal line drive circuit 3 in the liquid crystal display device as in the case of the above-mentioned embodiments. The load drive circuit 11 according to this embodiment includes switches SW10 to SW13, a differential amplifier circuit OP1 and a capacitor C10.

One end of the switch SW10 is supplied with the input video signal Vin. The other end of the switch SW10 is connected to one end of the capacitor C10 and one end of the switch SW11. The other end of the capacitor C10 is connected to one end of the switch SW12 and an inverting input terminal of the differential amplifier circuit OP1. A non-inverting input terminal of the differential amplifier OP1 is supplied with a reference voltage V10.

The other terminals of the switch SW11 and the switch SW12 are connected to an output terminal of the differential amplifier circuit OP1 and one end of the switch SW13. The other end of the switch SW13 is connected to the signal line S.

These switches SW10 to SW13 are also controlled by the switch control circuit 12 shown in FIG. 2, as in the case of the above-mentioned embodiments.

In FIG. 11, a connecting point of the switch SW10 and the capacitor C10 is the node "a", a connecting point of the capacitor C10 and switch SW12 is the node "b", a connecting point of the switches SW12 and SW13 is the node "c", a connecting point of the non-inverting input terminal of the differential amplifier circuit OP1 and the reference voltage V10 is the node "d", and a connecting point of the switch SW13 and the resistor R is the node "e".

The capacitor C10 forms a threshold voltage holding circuit in this embodiment, the switch SW11 and the capacitor C10 form a first negative feedback circuit in this embodiment, and the switch SW12 forms a second negative feedback circuit in this embodiment.

Figure 12:
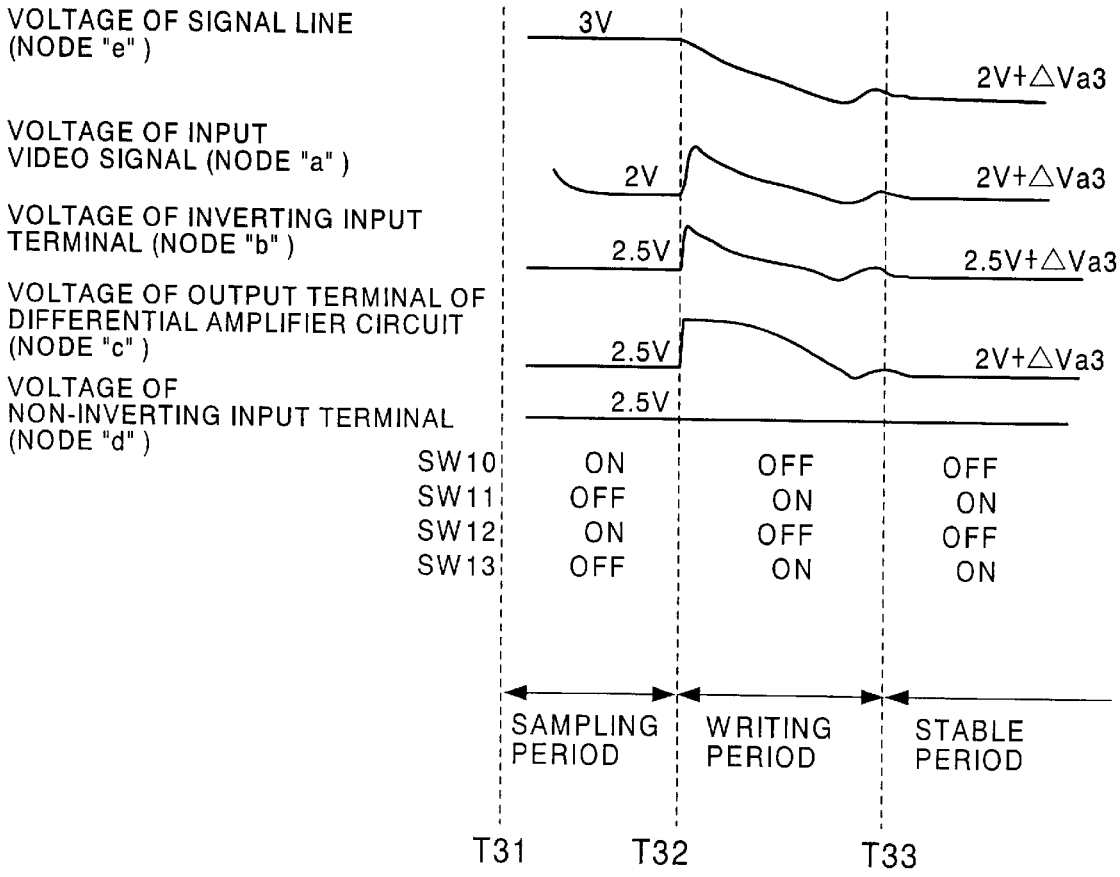
FIG. 12 is a timing chart of different points in the load drive circuit according to the forth embodiment.

FIG. 12 is a timing diagram of operations of respective portions in the load drive circuit 11 of FIG. 11. Explained below are operations of the load drive circuit 11 of FIG. 11, using this timing diagram.

First, in the period from the time T31 to the time T32 (sampling period), the switch control circuit 12 turns the switches SW10 and SW12 ON and turns the other switches SW11 and SW13 OFF. As a result, the voltage of the node "a" of FIG. 11 becomes substantially equal to the voltage of the input video signal Vin. FIG. 12 shows an example in which the voltage of the input video signal Vin is 2V. However, since the switch SW11 is OFF, the voltage of the signal line S (node "e" in FIG. 11) maintains the voltage supplied before the time T31. In an example of FIG. 12, it maintains 3V.

Since the switch SW12 is ON, the voltage of the output terminal of the differential amplifier circuit OP1 is fed-back to the inverting input terminal. Therefore, the differential amplifier circuit OP1 forms a voltage follower. Since the voltage of the non-inverting input terminal is the voltage of the reference voltage V10 (for example, 2.5V), the voltage of the output terminal (the node "c" of FIG. 11) is substantially equal to 2.5V. As a result, the capacitor C10 is set to have a differential voltage (for example, 0.5V) between the voltage of the input video signal Vin (for example, 2V) and the voltage of the output terminal of the differential amplifier circuit OP1 (for example, 2.5V).

In the periods after the time T32 (the writing period and the stable period), the switch control circuit 12 turns the switches SW11 and SW13 ON and turns the other switches SW10 to SW12 OFF. That is, in the status of the capacitor C10 holding 0.5V of the differential voltage, a voltage follower is formed by using the differential amplifier OP1. Therefore, the differential amplifier circuit OP1 repeats a negative feedback operation so that the voltage of the node "b" of FIG. 11 is at 2.5V, that is, the voltage of the node "b" is substantially equal to 2.5V which is the reference voltage.

To be more specific, the node "a" is at 2V whereas node "e" is at 3V in FIG. 11. Therefore, the voltage at the node "a"

rises due to affection by the node "e". The voltage at the node "b" which is the opposite end of the capacitor C10, also rises from 2.5V following the voltage at the node "a". As a result, the voltage of the output terminal of the differential amplifier circuit OP1 drops, and the voltage of the signal line S also drops. As the voltage of the signal line S drops, the voltages of the nodes "a" and "b" also drop.

When the voltage of the signal line S keeps dropping, the voltage of the node "a" drops under 2V, and the voltage of the node "b" also drops under 2.5V. Therefore, the voltage of the output terminal of the differential amplifier circuit OP1 rises, and the voltage of the signal line S also rises. By repeating this operation, after the time T33 (stable period), the voltage of the signal line S converges at 2V, which is the voltage of the input video signal Vin, and is stabilized at this voltage.

Actually, however, the voltages at the nodes "a", "c" and "e" of FIG. 11 are not completely stabilized at 2V. They are displaced by ΔVa3 of the offset voltage and become 2V+ΔVa3. Moreover, the voltage of the node "b" is also displaced by ΔVa3 and becomes 2.5V+ΔVa3. However, the gain of the differential amplifier circuit OP1 is large enough, so that the offset voltage ΔVa3 is considered substantially equal to be about 0V, and the voltages of the nodes "a", "c" and "e" of FIG. 11 are substantially equal to 2V.

As explained above, in the load drive circuit 11 according to the fourth embodiment, the negative feedback loop is constituted by the switch SW11 and the differential amplifier circuit OP1 with the differential voltage between the voltage of the input video signal Vin and the reference voltage V10 being held by the capacitor C10, so that the voltage of the signal line S is able to be set substantially equal to the voltage of the input video signal Vin.

That is, in the period between the time T31 and the time T32 (sampling period), the switches SW10 and SW12 are ON, and the differential voltage between the voltage of the input video signal Vin and the reference voltage V10 is set and held at the capacitor C10. Then, in the period after the time T32, the switches SW11 and SW13 are ON, and the negative feedback loop is constituted with the differential voltage being held by the capacitor C10. Therefore, the voltage of the signal line S is able to be set substantially equal to the voltage of the input video signal Vin.

The invention is not limited to the above-mentioned embodiments, but can be modified in various modes. For instance, in the embodiments described above, one example, in which the inverters INV1 to INV3 or threshold voltage setting inverter circuits 7, 8 and 9 are serially connected in three stages, was explained. However, the number of the stages is not limited to three. It may be an odd number of 1 or more. Furthermore, the supply voltages of the inverters INV1 to INV3 mentioned above is not limited to that in the example in FIG. 4, and the voltages V1 and V2 may be of a different value for each of the inverters INV1 to INV3.

In addition, though the inverters INV1 to INV3 are used as the inverting amplifier circuit 10, an inverting amplifier circuit with another structure can be used.

Furthermore, each of the inverters INV1 to INV3 may be a non-inverting amplifier circuit, and/or a non-inverting amplifier circuit may be added to each of the threshold voltage setting inverter circuits 7, 8 and 9.

In addition, in the above-mentioned embodiment, the switch control circuit 12 is configured to turn the both switches SW1 and SW2 ON/OFF simultaneously, but it is not always necessary to turn the both switches SW1 and SW2 ON/OFF simultaneously. Either of the switches SW1 or SW2 may be turned ON first during the period, only when the switch SW3 is OFF.

Moreover, in the third embodiment shown in FIG. 10, it is possible that the threshold voltage setting inverter circuit 7 without the capacitor is provided nearest to the input side of the inverting amplifier circuit and threshold voltage setting inverter circuits of even numbers with capacitor are serially connected.

As described above, according to the invention, the signal line voltage control circuit controls the voltage of the signal line so that the voltage of the signal line raises when the voltage of the signal line is lower than that of the input signal, whereas the voltage of the signal line drops when the voltage of the signal line is higher than that of the input signal. As a result, the voltage of the signal line is able to be set at the value substantially equal to that of the voltage of the input signal.

In addition, before controlling the voltage of the signal line, the voltage of each input terminal of each inverter constituting the signal line voltage control circuit is set at the threshold voltage thereof. Therefore, even if the threshold voltages of the inverters vary among them, it is possible that this would not exert any influence on the voltage of the signal line.

Therefore, when the invention is applied to a signal line drive circuit of a liquid crystal display device, for example, it is ensured to realize a liquid crystal display device integrally including a drive circuit, which has an excellent display quality free from luminance irregularity.

What is claimed is:

1. A load drive circuit supplied with an input signal having a predetermined voltage amplitude and supplying a signal line connected with a load with the voltage of the input signal, comprising:

a signal line voltage control circuit, a first terminal of which is connected to the signal line, configured to control the voltage of the signal line so as to rise the voltage of the signal line when the voltage of the signal line is lower than that of the input signal and drop the voltage of the signal line when the voltage of the signal line is higher than that of the input signal, the signal line voltage control circuit including an odd number of inverters connected in series and setting each input terminal of the inverters at each threshold voltage of the inverters;

a first differential voltage holding circuit, a first terminal of which is connected to a second terminal of the signal line voltage control circuit and a second terminal of which is connected to an input terminal of the input signal when the input signal is supplied and connected to the signal line when the signal line voltage control circuit controls the voltage of the signal line, the first differential voltage holding circuit holding a differential voltage between the threshold voltage of the inverter positioned nearest to the input side of the signal line voltage control circuit and the voltage of the input signal when the signal line voltage control circuit controls the voltage of the signal line; and a first differential voltage setting circuit configured to set the first differential voltage holding circuit at the differential voltage to be held in the first differential voltage holding circuit before the signal line voltage control circuit controls the voltage of the signal line.

2. The load drive circuit according to claim 1 wherein the signal line voltage control circuit comprises:

one or more second differential voltage holding circuits each connected between the inverters, and each configured to hold each differential voltage between the threshold voltages of each inverter when the signal line voltage control circuit controls the voltage of the signal line; and one or more second differential voltage setting circuits each configured to set each of the second differential voltage holding circuits at the each differential voltage to be held in the each second differential voltage holding circuit before the signal line voltage control circuit controls the voltage of the signal line.

3. The load drive circuit according to claim 2 wherein each of the second differential voltage holding circuits is formed of a capacitor, and each of the second differential voltage setting circuits is formed of a switch connecting between an output terminal and an input terminal of the inverter.

4. The load drive circuit according to claim 3 wherein the first differential voltage holding circuit is formed of a capacitor.

5. The load drive circuit according to claim 4 wherein the first differential voltage setting circuit comprises:

a first switch connecting between the second terminal of the first differential voltage holding circuit and the input terminal of the input signal; and a second switch connecting between the input terminal and the output terminal of the inverter positioned nearest to the input side of the signal line voltage control circuit.

6. The load drive circuit according to claim 3 wherein the first differential voltage holding circuit comprises:

a third differential voltage holding circuit connected to the input terminal of the input signal when the input signal is supplied and connected to the signal line when the signal line voltage control circuit controls the signal line;

a fourth differential voltage holding circuit connected between the third differential voltage holding circuit and the inverter positioned nearest to the input side of the signal line voltage control circuit; and a constant voltage supplying circuit configured to supply a constant voltage in a given period to a point between the third differential voltage holding circuit and the fourth differential voltage holding circuit, wherein the constant voltage supplying circuit supplies the constant voltage to the point between the third differential voltage holding circuit and the fourth differential voltage holding circuit when the differential voltage to be held in the first differential voltage holding circuit is set in the first differential voltage holding circuit.

7. The load drive circuit according to claim 6 wherein the third differential voltage holding circuit is formed of a capacitor and the fourth differential voltage holding circuit is formed of a capacitor.

8. The load drive circuit according to claim 1 wherein the load connected to the signal line comprises at least one pixel electrode.

9. A liquid crystal display device comprising:

a pixel array portion formed on a substrate, having signal lines and scanning lines aligned in longitudinal and transverse directions and having pixel electrodes near respective nodes of the lines; and a drive circuit formed on the substrate to drive driving lines which are the signal lines and/or the scanning lines, wherein the drive circuit includes at least one load drive circuit supplied with an input signal having a predetermined voltage amplitude and supplying the driving line with the voltage of the input signal, the load drive circuit comprising:

a driving line voltage control circuit, a first terminal of which is connected to the driving line, configured to control the voltage of the driving line so as to rise the voltage of the driving line when the voltage of the driving line is lower than that of the input signal and drop the voltage of the driving line when the voltage of the driving line is higher than that of the input signal, the driving line voltage control circuit including an odd number of inverters connected in series and setting each terminal of the inverters at each threshold voltage of the inverters;

a first differential voltage holding circuit, a first terminal of which is connected to a second terminal of the driving line voltage control circuit and a second terminal of which is connected to an input terminal of the input signal when the input signal is supplied and connected to the driving line when the driving line voltage control circuit controls the voltage of the driving line, the first differential voltage holding circuit holding a differential voltage between the threshold voltage of the inverter positioned nearest to the input side of the driving line voltage control circuit and the voltage of the input signal when the driving line voltage control circuit controls the voltage of the driving line; and a first differential voltage setting circuit configured to set the first differential voltage holding circuit at the differential voltage to be held in the first differential voltage holding circuit before the driving line voltage control circuit controls the voltage of the driving line.

10. A load drive circuit supplied with an input signal having a predetermined voltage amplitude and supplying a signal line connected with a load with the voltage of the input signal, comprising:

an inverting amplifier circuit, an output terminal of which is connected to the signal line when the inverting amplifier circuit controls the voltage of the signal line, including an odd number of threshold voltage setting inverter circuits connected in series, each of the threshold voltage setting inverter circuits having an inverter, a switch connecting between an input terminal and an output terminal of the inverter before the inverting amplifier circuit controls the voltage of the signal line, and a first capacitor connected to the input terminal of the inverter;

a second capacitor, one end of which is connected to an input side of the inverting amplifier circuit, and the other end of which is connected to an input terminal of the input signal when the input signal is supplied and connected to the signal line when the inverting amplifier circuit controls the voltage of the signal line; and a constant voltage supplying circuit connected to the one end of the second capacitor and configured to supply a given voltage when a differential voltage to be held in the second capacitor during the inverting amplifier circuit controlling the voltage of the signal line is set in the second capacitor.

11. A load drive circuit supplied with an input signal having a predetermined voltage amplitude and supplying a signal line connected with a load with the voltage of the input signal, comprising:

an inverting amplifier circuit, an output terminal of which is connected to the signal line when the inverting amplifier circuit controls the signal line, including:

a first threshold voltage setting inverter circuit positioned nearest to the input side of the inverting amplifier circuit, and having an inverter and a switch temporarily connecting between an input terminal and an output terminal of the inverter before the inverting amplifier circuit controls the voltage of the signal line; and an even number of second threshold voltage setting inverter circuits connected in series, each of the second threshold voltage setting inverter circuits having an inverter, a switch temporarily connecting between an input terminal and an output terminal of the inverter before the inverting amplifier circuit controls the voltage of the signal line and a first capacitor connected to the input terminal of the inverter; and a second capacitor, one end of which is connected to the input terminal of the first threshold voltage setting inverter circuit, and the other end of which is connected to an input terminal of the input signal when the input signal is supplied and connected to the signal line when the inverting amplifier circuit controls the voltage of the signal line.

12. A load drive circuit supplied with an input signal having a voltage amplitude and supplying a signal line connected a load with the voltage of the input signal, comprising:

a differential amplifier circuit having an inverting input terminal, a non-inverting input terminal suppliedwith a reference voltage and an output terminal connected to the signal line;

a differential voltage holding circuit connected to the inverting input terminal of the differential amplifier circuit and configured to hold a differential voltage between the voltage of the input signal and the reference voltage; and a first feedback circuit configured to supply the voltage of the input signal to the signal line while a feedback loop including the differential voltage holding circuit is constituted by connecting between the output terminal of the differential amplifier circuit and the differential voltage holding circuit with the differential voltage holding circuit holding the differential voltage.

13. The load drive circuit according to claim 12 wherein the first feedback circuit comprises a first switch connecting between the output terminal of the differential amplifier circuit and the differential voltage holding circuit, the first switch being ON when the feedback loop is constituted.

14. The load drive circuit according to claim 12 further comprising a second feedback circuit having a second switch connecting between the output terminal of the differential amplifier circuit and the inverting input terminal of the differential amplifier circuit, wherein a feedback loop is constituted by turning the second switch ON when the differential voltage holding circuit is set at the differential voltage.

15. The load drive circuit according to claim 12 wherein the differential voltage holding circuit is formed of a capacitor.

16. A liquid crystal display device comprising:

a pixel array portion formed on a substrate, having signal lines and scanning lines aligned in longitudinal and transverse directions and having pixel electrodes near respective nodes of the lines; and a drive circuit formed on the substrate to drive driving lines which are the signal lines and/or the scanning lines, wherein the drive circuit includes at least one load drive circuit supplied with an input signal having a predetermined voltage amplitude and supplying the driving line with the voltage of the input signal, the load drive circuit comprising:

a differential amplifier circuit having an inverting input terminal, a non-inverting input terminal supplied with a reference voltage and an output terminal connected to the driving line;

a differential voltage holding circuit connected to the inverting input terminal of the differential amplifier circuit and configured to hold a differential voltage between the voltage of the input signal and the reference voltage; and a first feedback circuit configured to supply the voltage of the input signal to the driving line while a feedback loop including the differential voltage holding circuit is constituted by connecting between the output terminal of the differential amplifier circuit and the differential voltage holding circuit with the differential voltage holding circuit holding the differential voltage.

* * * * *